US008079181B2

(12) United States Patent
Görz et al.

(10) Patent No.: US 8,079,181 B2
(45) Date of Patent: Dec. 20, 2011

(54) DOOR FOR A REFRIGERATING DEVICE

(75) Inventors: Alexander Görz, Aalen (DE); Karl-Friedrich Laible, Langenau (DE); Hans-Philipp Reitz, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 627 days.

(21) Appl. No.: 12/226,378

(22) PCT Filed: Apr. 3, 2007

(86) PCT No.: PCT/EP2007/053259

§ 371 (c)(1), (2), (4) Date: Oct. 16, 2008

(87) PCT Pub. No.: WO2007/122081

PCT Pub. Date: Nov. 1, 2007

(65) Prior Publication Data

US 2009/0084128 A1 Apr. 2, 2009

(30) Foreign Application Priority Data

Apr. 20, 2006 (DE) ..... 10 2006 018 424

(51) Int. Cl.
*E06B 3/00* (2006.01)

(52) U.S. Cl. ..... 49/501; 49/463; 312/138.1

(58) Field of Classification Search ..... 49/501, 49/463, 466; 403/329, 295, 298; 312/138.1 X, 312/140, 116, 326, 327, 328, 329
See application file for complete search history.

(56) References Cited

U.S. PATENT DOCUMENTS

| | | | | |
|---|---|---|---|---|
| 2,720,683 | A | 10/1955 | Schwenker et al. | |
| 2,780,845 | A | 2/1957 | Chapman et al. | |
| 3,294,461 | A * | 12/1966 | Barnard et al. | 312/213 |
| 3,525,190 | A * | 8/1970 | Betz et al. | 52/784.15 |
| 3,828,763 | A * | 8/1974 | Wilson | 126/200 |
| 3,936,107 | A * | 2/1976 | Gourdeau et al. | 312/329 |
| 4,948,206 | A * | 8/1990 | Fitzpatrick | 312/296 |

(Continued)

FOREIGN PATENT DOCUMENTS

DE 2 044 430 5/1972

(Continued)

OTHER PUBLICATIONS

International Search Report PCT/EP2007/053259.

*Primary Examiner* — Jerry Redman
(74) *Attorney, Agent, or Firm* — James E. Howard; Andre Pallapies

(57) ABSTRACT

A door for a refrigerating unit is provided that includes a door leaf hinged to a body of the refrigerating unit and a decorative element that is superimposed on the door leaf in such a way as to be adjustable in position. The decorative element has a central cutout, through which a central region of the door leaf is exposed. A groove open towards this central region is formed on the door leaf in order to accommodate a profile element which conceals a gap between door leaf and decorative element.

19 Claims, 3 Drawing Sheets

U.S. PATENT DOCUMENTS

| | | | | | |
|---|---|---|---|---|---|
| 4,966,004 | A | * | 10/1990 | Midlang et al. | 62/77 |
| 5,358,326 | A | * | 10/1994 | Cherry et al. | 312/405 |
| 5,571,276 | A | * | 11/1996 | Kobos et al. | 312/265.6 |
| 5,645,331 | A | * | 7/1997 | Eddy et al. | 312/205 |
| 5,806,942 | A | * | 9/1998 | Jenkins et al. | 312/204 |
| 6,561,180 | B1 | * | 5/2003 | Austin et al. | 126/198 |
| 6,736,470 | B2 | * | 5/2004 | Manke et al. | 312/228 |
| 7,207,636 | B2 | * | 4/2007 | Livingston et al. | 312/265.6 |
| 7,516,531 | B2 | * | 4/2009 | Crompton et al. | 29/428 |
| 7,770,985 | B2 | * | 8/2010 | Davis et al. | 312/204 |
| 2009/0045712 | A1 | * | 2/2009 | Laible | 312/401 |
| 2009/0302723 | A1 | * | 12/2009 | Laible et al. | 312/237 |

FOREIGN PATENT DOCUMENTS

| | | | | |
|---|---|---|---|---|
| DE | 201 00 997 | U | | 5/2001 |
| DE | 102007021559 | A1 | * | 11/2008 |
| EP | 1 382 924 | | | 1/2004 |
| WO | WO 2007/062903 | | | 6/2007 |

* cited by examiner 2
3
28
26
24
29
17
5
18
23
19
16
21
22
20
27
25
12
15
14
13

DOOR FOR A REFRIGERATING DEVICE

BACKGROUND OF THE INVENTION

The present invention relates to a door for a refrigeration appliance with a door leaf and a decorative element attached to the front of the door leaf in such a manner that its position can be adjusted.

Built-in refrigeration appliances generally have a decorative element attached in the form of a panel, which covers the door leaf completely. It must be possible to adjust the position of the decorative panel in a number of spatial directions in relation to the door leaf, so that it can be moved into a position where it is flush with the adjacent furniture fronts and is separated from these by gaps of uniform width.

It is also known that the door of a wine storage cabinet can be provided with a decorative element in the form of a wooden frame, exposing a glass window in the door leaf, so that the contents of the wine storage cabinet are visible, without the door having to be opened. Such a frame is conventionally mounted without a gap between it and the door leaf. This makes it very difficult to adjust the frame precisely, so that it adjoins adjacent furniture fronts harmoniously in the manner known to users from built-in appliances.

The techniques known from built-in refrigeration appliances for the adjustable attachment of a decorative element are inadequate here, because the gap required between the door leaf and decorative element for adjustment depthwise, when the decorative element is a frame, is clearly visible at the edge of its cutout and there is a risk of dirt or small foreign bodies penetrating into the gap.

BRIEF SUMMARY OF THE INVENTION

The object of the present invention is to create a door with a door leaf and a decorative element attached to the front of the door leaf in such a manner that its position can be adjusted, which allows the gap to be covered in a simple manner despite its variable width.

The object is achieved in that, if the decorative element has a central cutout, through which a central region of the door leaf is exposed, a groove open toward said central region is formed on the door leaf. This groove makes it readily possible to mount a profile element covering the gap, as explained in more detail below.

The groove is preferably covered by the decorative element itself.

If the door leaf has a central panel set in a frame profile, the groove is expediently formed in the frame profile itself.

The central panel is preferably an insulating glass pane.

To cover the gap between the door leaf and the decorative element, a profile element can be held in the groove, touching an edge of the central cutout in the decorative element.

This profile element is preferably an L-profile, a first arm of which engages in the groove, the other resting against the edge of the central cutout.

The arm of the profile element engaging in the groove is expediently provided with weak points running in a longitudinal direction. These weak points allow the arm to be shortened in a simple manner, thus ensuring that the other arm can touch the edge of the central cutout, even if there is only a little space between this edge and the adjacent groove.

The weak points are preferably configured as corrugations. A knife or scissors used to shorten the arm is/are guided automatically in said corrugations, so that no further aids are needed to shorten the arm to a constant width.

If ribs engaging in the corrugations are molded on a side wall of the groove, this also improves the security of the profile element at the groove. Also a form fit between the corrugations and the ribs allows the profile element to be securely anchored, even when poorly clamped, so that the profile element can still be displaced longitudinally when it is mounted in the groove.

To cover abutting ends of two profile elements in a corner of the cutout, a cover part is preferably attached in such a corner. In particular when such a cover part is present, the above-mentioned ability of the profile elements to be displaced longitudinally is desirable, to ensure that despite tolerances in the dimensioning of the profile elements, their ends can be concealed behind the cover part.

An adapter part is preferably attached respectively to one end of each profile element, on which the cover element can be positioned in the direction of the depth of the door leaf.

This adapter part is expediently made from a more rigid material than the profile element, to allow secure latching of the cover part.

To anchor it to the profile element the adapter part preferably has a pin, which engages with a friction lock in an oblong cavity in the profile element.

The adapter part preferably also has a slot, which extends in the longitudinal direction of the profile element to which the adapter part is attached and a latching projection on the cover part latches into the slot.

In particular if the cover part is latched into the slot with some clearance in the longitudinal direction, inaccuracies in the cutting to size of the profile elements can be compensated for easily.

BRIEF DESCRIPTION OF THE DRAWINGS

Further features and advantages of the invention will emerge from the description which follows of exemplary embodiments with reference to the accompanying figures, in which.

DETAILED DESCRIPTION OF THE PRESENT INVENTION

Figure 1:
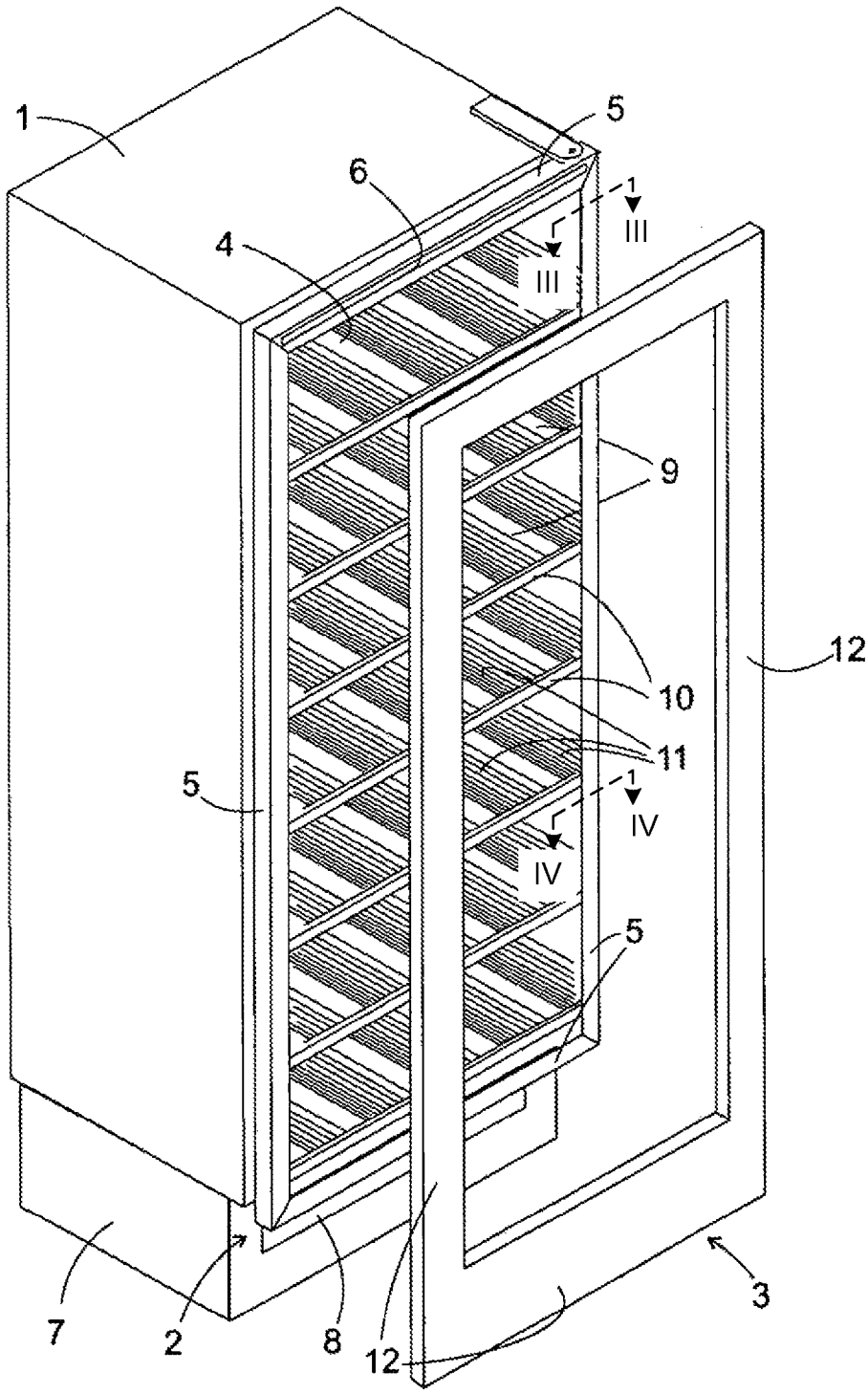
FIG. 1 shows a perspective view of a wine storage cabinet as an exemplary embodiment of an inventive refrigeration appliance.

FIG. 1 shows a perspective view of a bottle storage cabinet with a body 1, a door leaf 2 hinged to the body 1 and, shown a distance from the door leaf 2, a decorative frame 3 made of wood, which is provided for mounting on the door leaf 2. The door leaf 2 is essentially formed by an insulating glass pane 4 of known design, which is bordered at its four edges by aluminum profiles 5 connected to one another in a rigid manner. A rail 6 is attached to one of the profiles 5, which forms the upper segment of the door leaf 2, said rail 6 being used to suspend the decorative frame 3. In the mounted state the decorative frame 3 covers the profiles 5 completely.

Compressors and condensers of a refrigeration unit of the bottle storage cabinet are accommodated in an appliance base 7 below the thermally insulating body 1. A ventilation grid 8 on the front face of the appliance base 7 is concealed by the decorative frame 3 extending at its lower edge beyond the contour of the door 2.

The interior of the body 1 is visible through the insulating glass pane 4. A number of bottle holders 9 are arranged in said interior, formed respectively by front and rear transverse supports 10 and moldings 11 in the shape of cylinder segments suspended from said transverse supports 10 and extended in the direction of the depth of the bottle storage cabinet. Each of the moldings 11 can hold one bottle lying down.

Figure 2:
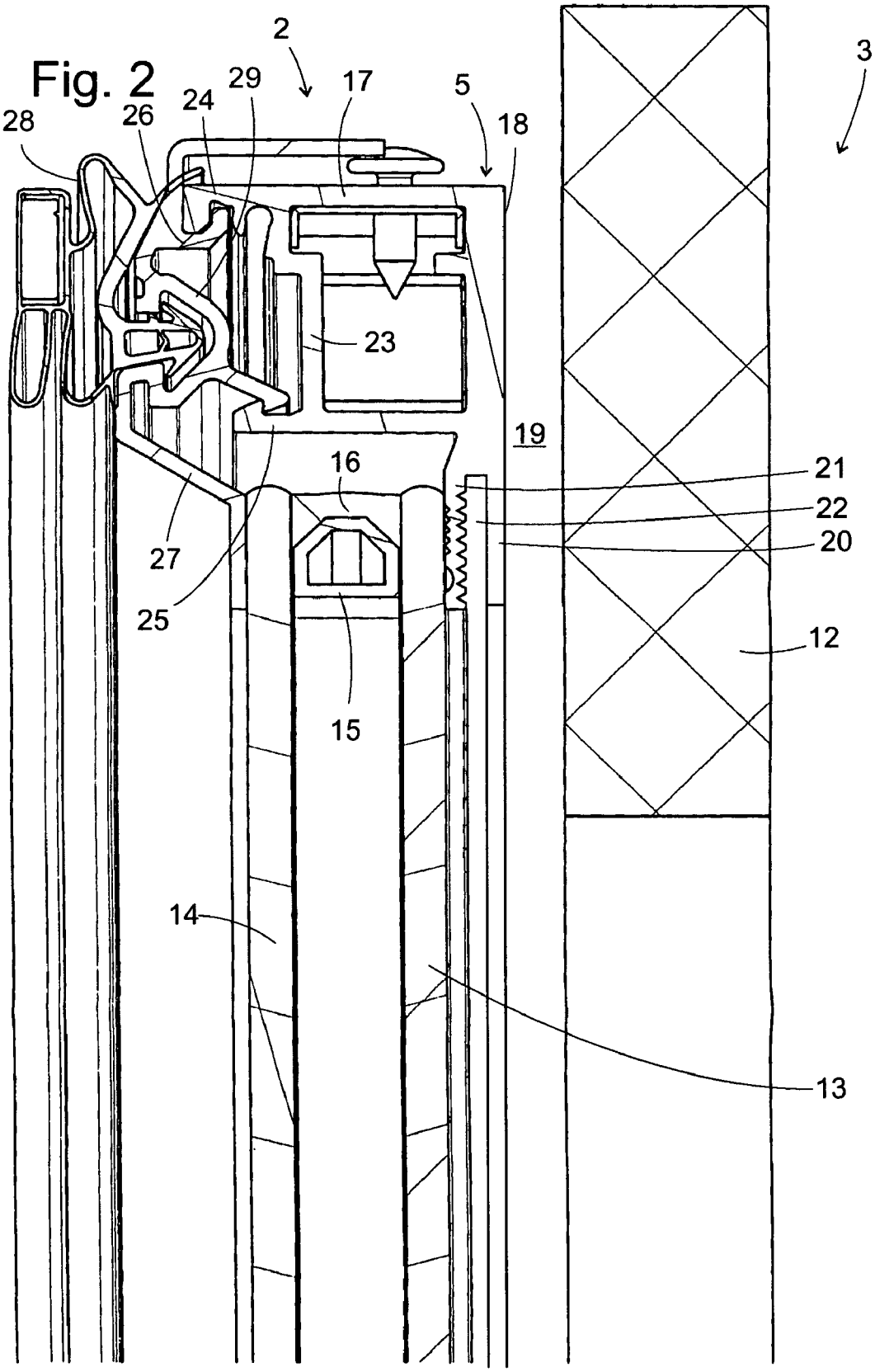
FIG. 2 shows a cross-section through a peripheral region of the door of the wine storage cabinet and a decorative frame mounted on the door as shown along III-III in FIG. 1.

FIG. 2 shows a cross-section through a vertical edge of the door leaf 2 and a strip 12 of the decorative frame 3 mounted in front of it. The cross-section shows the structure of the insulating glass pane 4 which is made up of two parallel glass plates 13, 14, kept at a distance parallel to each other by an aluminum profile 15 inserted between them. A sealing mass 16 applied externally around the profile 15 seals the intermediate space between the glass plates 13, 14 in an airtight manner.

The aluminum profile 15 forming the frame of the door leaf 2 is a hollow profile with a basic body of roughly rectangular cross-section. Two of the four faces of the basic body form an outer face 17 and a front face 18, which face the strip 12, separated by a gap 19. The front face 18 of the rectangular basic body is extended inward to lie flush by a stud 20 projecting out over a peripheral region of the insulating glass pane 4. A second stud 21 parallel to the stud 20 forms a stop for the outer glass pane 13. The two studs 20, 21 form side walls of a groove 22 open toward the center of the door leaf 2.

Two studs 24, 25 projecting from a rear face 23 of the basic body bound a recess, in which an extruded profile element 26 made of plastic is hooked. An elastic arm 27 of the extruded profile element 26 holds the insulating glass pane 4 pressed against the stud 20. This arm 27 therefore secures the insulating glass pane 4 and at the same time prevents air from the interior of the body 1 reaching the profile 5 with its good heat-conducting properties and cooling it.

A magnetic seal 28, which is known per se and is therefore not described here in detail, is anchored in a groove 29 in the extruded profile element 26.

Figure 3:
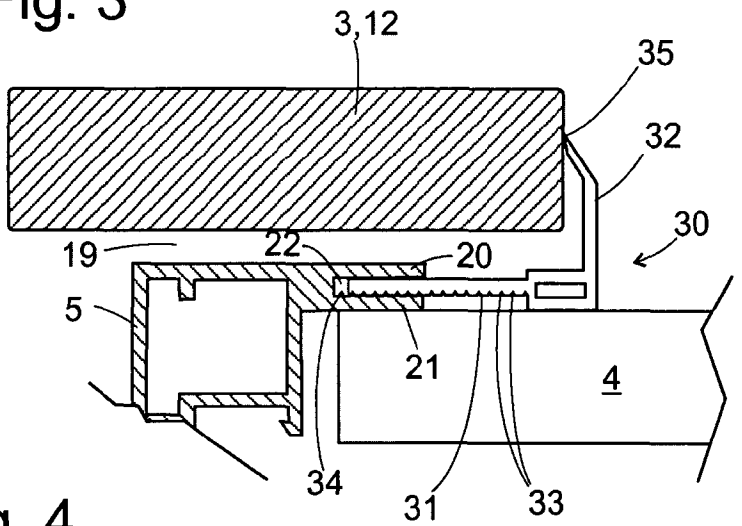
FIG. 3 shows a simplified cross-sectional diagram of the peripheral region of the door and the decorative frame with a gap covered by a profile element as shown along IV-IV in FIG. 1.

FIG. 3 shows a simplified cross-section of a profile element 30 compared with FIG. 2, closing the gap 19 along the edges of the cutout in the decorative frame 3. The profile element 30 has an essentially L-shaped cross-section with one arm 31 parallel to the insulating glass pane 4 and one arm 32 essentially perpendicular thereto, touching the edge of the cutout in the decorative frame 3. The profile element 30 is made from a pliable, rubber-elastic material, whose rigidity is dimensioned sufficiently for the arm 31 to be inserted easily but still securely into the groove 22.

On its face facing the insulating glass pane 4 the arm 31 has a number of corrugations 33 running in its longitudinal direction and the stud 21 is provided with ribs 34 that complement said corrugations 33, allowing secure form-fit latching of the arm 31 in the groove 22. The engaging of the ribs 34 and corrugations 33 with one another means that the profile element 30 can be displaced more easily in the longitudinal direction of the groove 22 than in the direction of its depth.

In the configuration in FIG. 3 the depth of the groove 22 is significantly smaller than the width of the arm 31 engaging in it and supporting the corrugations 33. It is thus possible to shorten the arm 31 if necessary by cutting along one of the corrugations 33. This may be necessary if, with the decorative frame 3 in an adjusted position, the strip 12 is offset so far to the left compared with the position shown in FIG. 3 that a gap remains between the inner edge of the strip 12 and the distal edge 35 of the profile element 30, when the profile element 30 is inserted into the groove 22 to its base. In such a situation the arm will be shortened during mounting to such an extent that when the arm 31 is inserted into the groove 22 to its base, the profile element 30 is slightly deformed and its distal edge 35 pushes against the strip 12 in an elastic manner.

Figure 4:
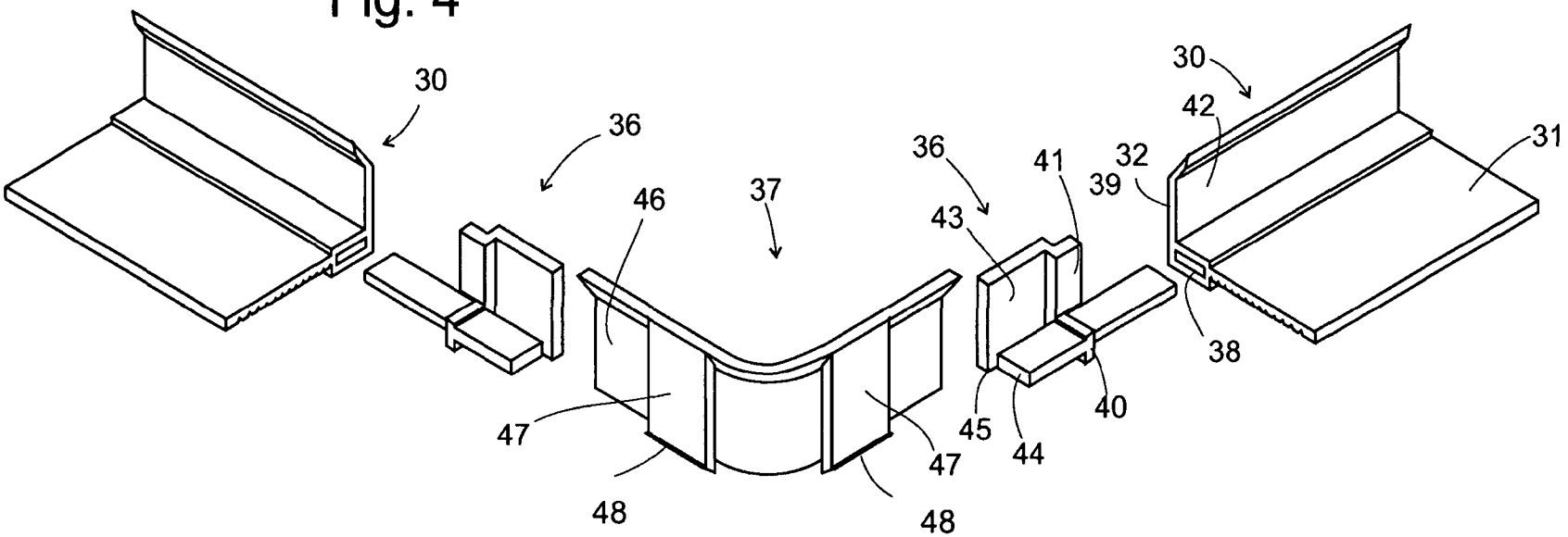
FIG. 4 shows a perspective exploded view of profile elements, adapter parts and cover parts for a corner of the frame.

In principle it is possible, after the decorative frame 3 has been adjusted on the door leaf 2, for profile elements 30 to be cut to size for all four edges of the cutout in the decorative frame 3, so that they abut exactly against one another at the corners of the cutout, completely closing off the gap 19. However this requires a high level of precision when measuring and cutting the profile elements 30 and this is difficult to guarantee when a refrigeration appliance is installed on the customer's premises. A development, which also allows the gap 19 to be closed off reliably in the corners of the frame cutout with little outlay, is therefore described with reference to FIG. 4. This figure shows a perspective view of two profile elements 30 and of adapter parts 36 and a cover part 37, which serve to connect the profile elements 30 at a corner of the cutout.

It can be seen that an oblong cavity 38 is formed in a core region of the profile element 30, in which the two arms 31, 32 abut against one another. Each of the two mirror-symmetrical adapter parts 36 has a pin 39, which fits with a form fit and friction lock in the oblong cavity 38 in the profile element 30 shown adjacent thereto. The pin 39 projects from a base plate 40, which rests against the end face of the profile element 30 when the pin 39 is inserted into the oblong cavity 38. One edge of the base plate and the core region of the profile element 30 rest against the outer glass pane 13 (not shown in FIG. 4). Two vertical walls shown in the perspective view in FIG. 4 project from the base plate 40, supporting the inner face 42 of the arm 32 facing the gap 19, when the base plate 40 rests against the end face of the profile element 30, as does a wall 43, which extends the outer face of the arm 32 so that it lies flush.

A plate 44 projecting from the base plate 40 counter to the pin 39 is separated from the wall 43 by a gap 45. The plate 44 is also at a distance from the outer glass pane 13.

The cover part 37 is an angle piece with an outer wall 46, which in the assembled state covers the two adapter parts 36 and end regions of the profile elements 30 adjacent to these. Two latching tongues 47 are molded to the outer wall 46 to form a single part, extending essentially in the vertical direction in FIG. 4, in other words in the direction of the depth of the door leaf. When the cover part 37 is brought into position depthwise on the adapter parts 36, in other words from above in the perspective view in FIG. 4, the latching tongues 47 penetrate respectively into the gap 45 between the wall 43 and the plate 44 of each adapter part 36 and an abutment 48 on each latching tongue 47 comes to rest against the rear face of the plate 44 facing the glass pane 13. To ensure that the adapter parts 36 do not yield to the pressure of the latching tongue 47, the wall 43 is dimensioned in each instance so that it also touches the insulating glass pane 4 when the pin 39 is inserted into the oblong cavity 38 in the profile element 30 resting against the insulating glass pane 4.

Latching secures the cover part 47 in the direction of the depth of the door leaf. However the profile elements 30 can be displaced in their longitudinal direction in relation to the cover parts 37 bordering them at their ends, as the latching tongue 47 can be displaced respectively in the gap 45 in the adapter part 36, which is open toward the edge. Inaccuracies in the dimensioning of the lengths of the profile elements 30 in the region of the freedom of movement for displacement of the profile elements, in other words up to the width of the latching tongue 47 or the length of the slot 45, can therefore be concealed by the cover parts 37.

The invention claimed is:

1. A door for a refrigeration appliance, the door comprising:

a door leaf that can be hingedly mounted to a body of the refrigeration appliance; and a decorative element adjustably attached to the front of the door leaf, the decorative element having a central cutout through which a central region of the door leaf is exposed and a groove open toward the central region of the door leaf, wherein the groove is configured to receive a profile element such that the grove holds the profile element in a position in which the profile element touches an edge of the central cutout in the decorative element, and the groove is configured to allow the profile element to be moved between a plurality of positions relative to the groove so that the profile element can be positioned in the position in which the profile element touches an edge of the central cutout in the decorative element.

2. The door as claimed in claim 1, wherein the groove is covered by the decorative element.

3. The door as claimed in claim 1, wherein the groove is formed in a frame profile, which borders a central panel of the door leaf.

4. The door as claimed in claim 3, wherein the central panel is an insulating glass pane.

5. The door as claimed in claim 1, wherein the profile element is an L-profile, the first arm of which engages in the groove, the other resting against the edge of the central cutout.

6. The door as claimed in claim 1, wherein an arm of the profile element engaging in the groove has break points running in a longitudinal direction.

7. The door as claimed in claim 6, wherein the break points are corrugations.

8. The door as claimed in claim 1, wherein a cover part attached in a corner of the cutout covers ends of two profile elements adjacent to the corner.

9. The door as claimed in claim 8, wherein an adapter part is attached to an end of each profile element, on which the cover part can be positioned in the direction of the depth of the door leaf.

10. The door as claimed in claim 9, wherein the adapter part is made from a more rigid material than the profile element.

11. The door as claimed in claim 9, wherein the adapter part has a pin, which engages with a friction lock in an oblong cavity in the profile element.

12. The door as claimed in claim 9, wherein the adapter part has a slot, which extends in the longitudinal direction of the profile element to which the adapter part is attached and a latching projection on the cover part latches into the slot.

13. The door as claimed in claim 12, wherein the cover part is latched into the slot with some clearance in the longitudinal direction.

14. A door for a refrigeration appliance, the door comprising:

a door leaf that can be hingedly mounted to a body of the refrigeration appliance;

a decorative element adjustably attached to the front of the door leaf, the decorative element having a central cutout through which a central region of the door leaf is exposed and a groove open toward the central region of the door leaf; and a profile element held in the groove and touching an edge of the central cutout in the decorative element, wherein an arm of the profile element engaging in the groove has break points running in a longitudinal direction, the break points are corrugations, and ribs engaging in the corrugations are formed on a side wall of the groove.

15. A door for a refrigeration appliance, the door comprising:

a door leaf that can be hingedly mounted to a body of the refrigeration appliance;

a decorative element adjustably attached to the front of the door leaf, the decorative element having a central cutout through which a central region of the door leaf is exposed and a groove open toward the central region of the door leaf; and a profile element held in the groove and touching an edge of the central cutout in the decorative element, wherein a cover part attached in a corner of the cutout covers ends of two profile elements adjacent to the corner, and an adapter part is attached to an end of each profile element, on which the cover part can be positioned in the direction of the depth of the door leaf.

16. The door as claimed in claim 15, wherein the adapter part is made from a more rigid material than the profile element.

17. The door as claimed in claim 15, wherein the adapter part has a pin, which engages with a friction lock in an oblong cavity in the profile element.

18. The door as claimed in claim 15, wherein the adapter part has a slot, which extends in the longitudinal direction of the profile element to which the adapter part is attached and a latching projection on the cover part latches into the slot.

19. The door as claimed in claim 18, wherein the cover part is latched into the slot with some clearance in the longitudinal direction.

* * * * *